United States Patent [19]

Nagasawa et al.

[11] Patent Number: 4,824,552

[45] Date of Patent: Apr. 25, 1989

[54] HIGH-OCTANE-RATING GASOLINES

[75] Inventors: Takao Nagasawa, Kawasaki; Kingo Ikeda, Yokohama; Hirotsugu Nomura, Chigasaki, all of Japan

[73] Assignee: Nippon Oil Co., Ltd., Tokyo, Japan

[21] Appl. No.: 196,005

[22] Filed: May 19, 1988

[30] Foreign Application Priority Data

May 20, 1987 [JP] Japan ..... 62-123129
Jun. 19, 1987 [JP] Japan ..... 62-153026

[51] Int. Cl.[4] ..... C10L 1/04

[52] U.S. Cl. ..... 208/17; 208/16; 44/50

[58] Field of Search ..... 208/16, 17; 44/50

[56] References Cited

U.S. PATENT DOCUMENTS 2,968,609 1/1961 Lutz ..... 208/16
3,177,653 4/1965 Barnes et al. ..... 44/50
3,316,168 4/1967 Mernitz ..... 44/50
4,387,257 6/1983 Burns ..... 44/50

FOREIGN PATENT DOCUMENTS 607873 11/1960 Canada ..... 208/17
779272 2/1968 Canada ..... 208/17

*Primary Examiner*—H. M. S. Sneed
*Assistant Examiner*—Helane Myers
*Attorney, Agent, or Firm*—Bruce L. Adams; Van C. Wilks

[57] ABSTRACT

Lead-free, high-octane gasoline is disclosed which is so composed as to have specified distillation and composition characteristics. The gasoline is excellent with respect to stability to ambient conditions, acceleration over a wide range of running speeds, and startability and warmup at low temperature.

5 Claims, No Drawings

HIGH-OCTANE-RATING GASOLINES

BACKGROUND OF THE INVENTION

1. Field of the Invention

This invention relates to lead-free, high-octane gasolines and more particularly to such gasolines having specified distillation and composition characteristics.

2. Description of the Prior Art

Lead-free, regular gasoline rated at 90 or 91 in octane number and marketed in 1975 is known to invite knocking under certain driving conditions. More advanced gasoline has since 1984 become predominant which has a higher octane number of 96 or even 98 and has the least susceptibility to such problems.

The advent of highly sophisticated automobiles, however, has recently lent an impetus to an improved gasoline of the above type which can render the automobile readily startable, sufficiently accelerative over a wide range of speeds on roads and hills, and stably runnable.

SUMMARY OF THE INVENTION

It is the primary object of the present invention to provide a novel gasoline free from lead and of high octane number which will exhibit sufficient stability, excellent acceleration at various speeds from stop to low to moderate to high and high to higher and also during slope ascending, and reliable startability and adequate warmup at low temperature, thus ensuring efficient and safe driving.

Another object of the invention is to provide such a gasoline of high research octane number which has its olefins content held at a selected level, leading to enhanced stability.

As will be better understood from the following description, a gasoline according to one aspect of the invention is free from lead and high in octane number and is comprised of base gasolines so blended as to meet the distillation and composition characteristics of equations (I) to (VI)

$$60 \leqq T_{70} - T_{30} \leqq 85\ (°C.) \quad \text{(I)}$$

$$0.15 \leqq \frac{T_{90} - T_{70}}{T_{70} - T_{30}} < 0.50 \quad \text{(II)}$$

$$VO(\text{WHOLE}) \leqq 25\ (\text{vol. \%}) \quad \text{(III)}$$

$$VA(\text{WHOLE}) \leqq 50\ (\text{vol. \%}) \quad \text{(IV)}$$

$$VO(\leqq T_{30}) \geqq 40\ (\text{vol. \%}) \quad \text{(V)}$$

$$VA(\geqq T_{70}) \geqq 85\ (\text{vol. \%}) \quad \text{(VI)}$$

where $T_{30}$ is a 30% distillation temperature, $T_{70}$ is a 70% distillation temperature, $T_{90}$ is a 90% distillation temperature, VO(WHOLE) is an olefins content in the total gasoline, VA(WHOLE) is an aromatics content in the total gasoline, VO($\leqq T_{30}$) is an olefins content in the total volume of a fraction boiling at or below $T_{30}$, and VA($\geqq T_{70}$) is an aromatics content in the total volume of a fraction boiling at or above $T_{70}$.

According to another aspect of the invention, there is provided a gasoline free from lead and of greater than 95 research octane number which comprises base gasolines and at least one fuel component in an amount of 5 to 40% by volume of the total gasoline, the fuel component being either one or both of an isomerate and a n-paraffin-free oil, thereby meeting the distillation and composition characteristics of equations (VII) to (XII)

$$60 \leqq T_{70} - T_{30} \leqq 85\ (°C.) \quad \text{(VII)}$$

$$0.15 \leqq \frac{T_{90} - T_{70}}{T_{70} - T_{30}} < 0.50 \quad \text{(VIII)}$$

$$0 \leqq VO(\text{WHOLE}) \leqq 25\ (\text{vol. \%}) \quad \text{(IX)}$$

$$VA(\text{WHOLE}) \leqq 50\ (\text{vol. \%}) \quad \text{(X)}$$

$$0 \leqq VO(< T_{30}) \leqq 40\ (\text{vol. \%}) \quad \text{(XI)}$$

$$VA\ (\geqq T_{70}) \geqq 85\ (\text{vol. \%}) \quad \text{(XII)}$$

where $T_{30}$ is a 30% distillation temperature, $T_{70}$ is a 70% distillation temperature, $T_{90}$ is a 90% distillation temperature, VO(WHOLE) is an olefins content in the total gasoline, VA(WHOLE) is an aromatics content in the total gasoline, VO($\leqq T_{30}$) is an olefins content in the total volume of a fraction boiling at or below $T_{30}$, and VA($\geqq T_{70}$) is an aromatics content in the total volume of a fraction boiling at or above $T_{70}$.

DETAILED DESCRIPTION OF THE INVENTION

A gasoline according to a first preferred embodiment of the invention should meet all of the characteristics represented by equations (I) to (VI).

Equations (I) and (II) are directed to the distillation characteristics of the gasoline:

$$60 \leqq T_{70} - T_{30} \leqq 85\ (°C.) \quad \text{(I)}$$

$$0.15 \leqq \frac{T_{90} - T_{70}}{T_{70} - T_{30}} < 0.50 \quad \text{(II)}$$

$T_{30}$, $T_{70}$ and $T_{90}$ are the distillation temperatures at which to produce distillates up to 30, 70 and 90%, respectively. These temperatures are determinable by the method stipulated in JIS K-2254.

By the subtractions $T_{70}$–$T_{30}$ and $T_{90}$–$T_{70}$ are meant the difference between the 70% and 30% distillation temperatures and the difference between the 90% and 70% distillation temperatures. As seen from equation (I), the $T_{70}$–$T_{30}$ difference should be from 60° to 85° C., preferably 65° to 80° C. The ratio of $T_{90}$–$T_{70}$ to $T_{70}$–$T_{30}$, as shown in equation (II), should be in the range of 0.15 to not more than 0.50, preferably 0.25 to below 0.45.

Equations (I) and (II) should be observed to preclude a sharp decline in acceleration at various running speeds and also in startability and warmup at low temperature.

Equations (III) to (VI) define the composition characteristics of the gasoline:

$$VO(\text{WHOLE}) \leqq 25\ (\text{vol. \%}) \quad \text{(III)}$$

$$VA(\text{WHOLE}) \leqq 50\ (\text{vol. \%}) \quad \text{(XII)}$$

$$VO(\leqq T_{30}) \geqq 40\ (\text{vol. \%}) \quad \text{(V)}$$

$$VA(\geqq T_{70}) \geqq 85\ (\text{vol. \%}) \quad \text{(VI)}$$

VO(WHOLE) is an olefins content in the total gasoline, and VA(WHOLE) is an aromatics content in the total gasoline. VO($\leqq T_{30}$) is an olefins content in the total volume of a fraction distilling at or below $T_{30}$. VA($\geqq T_{70}$) is an aromatics content in the total volume of a fraction distilling at or above $T_{70}$. Measurement of the olefins and aromatics contents is made according to JIS K-2536.

As appears clear from equations (III) to (VI), the olefins content in the total gasoline should be not more than 25% by volume, preferably smaller than 20% by volume, whereas the aromatics present in the total gasoline should be in an amount less than 50% by volume, preferably not more than 45% by volume. The fraction at or lower than $T_{30}$ should have an olefins content exceeding 40% by volume, preferably greater than 50% by volume. In the fraction at or higher than $T_{70}$, the aromatics content should be above 85% by volume, preferably larger than 90% by volume.

Failure to satisfy even one of equations (III) and (IV) would make the finished gasoline unstable and hence ready to develop objectionable exhaust gas, resulting in impaired structural material used for the automotive fuel system. Equations (V) and (VI) if not met would lead to reduced acceleration.

A second preferred embodiment of the invention involves the use of a selected class of fuel components combined with base gasolines, thereby meeting the distillation characteristics of equations (VII) and (VIII) and also the composition characteristics of equations (IX) to (XII):

$$60 \leqq T_{70} - T_{30} \leqq 85\ (°C.) \quad \text{(VII)}$$

$$0.15 \leqq \frac{T_{90} - T_{70}}{T_{70} - T_{30}} < 0.50 \quad \text{(VIII)}$$

$$0 \leqq VO(\text{WHOLE}) \leqq 25\ (\text{vol. }\%) \quad \text{(IX)}$$

$$VA(\text{WHOLE}) \leqq 50\ (\text{vol. }\%) \quad \text{(X)}$$

$$0 \leqq VO(\leqq T_{30}) \leqq 40\ (\text{vol. }\%) \quad \text{(XI)}$$

$$VA\ (\geqq T_{70}) \geqq 85\ (\text{vol. }\%) \quad \text{(XII)}$$

Equations (VII), (VIII), (X) and (XII) correspond to and have the same definitions as equations (I), (II), (IV) and (VI) of the first embodiment and consequently will need no additional explanation. In the second embodiment, the olefins contents should range from 1 to 25% by volume, preferably 0 to 20% by volume, in the total gasoline and from 0 to 40% by volume, preferably 0 to 30% by volume, in the total volume of a fraction distilling at or lower than $T_{30}$ as is apparent from equations (IX) and (XI). These two equations are defined to further improve stability of the resulting gasoline.

The gasoline of the second embodiment should to this end contain as a fuel component a selected isomerate or a selected oil devoid of n-paraffins, or an admixture thereof.

Isomerates useful in the invention are fractions boiling in the range of 25° to 85° C. and obtained by isomerizing either one or both of pentane and hexane originated for example from naphtha, natural gasoline, straight-run gasoline, reformed gasoline and the like, i.e. by converting straight paraffinic hydrocarbons to the corresponding side-chained isomers without changing their chemical compositions. The fraction so isomerized is composed predominantly of branched paraffinic hydrocarbons such as isopentane, 2-methylpentane, 3-methylpentane, 2,2-dimethylbutane, 2,3-dimethylbutane and the like. Also contained in the isomerate are small amounts of unreacted straight paraffinic hydrocarbons such as n-pentane and n-hexane, and naphthenic hydrocarbons such as cyclopentane, methylcyclopentane, cyclohexane and the like.

Any catalysts, reaction conditions and processes known in common use are suitable for the isomerization reaction. Catalysts for use in general isomerization may conveniently be selected for example from Friedel-Crafts type catalysts including aluminum halides such as aluminum chloride, aluminum bromide and the like and their blends with halogenated hydrocarbon co-catalysts such as hydrogen chloride and the like. Hydroisomerization usually employs dual-purpose catalysts made up of active metals such as platinum, nickel and the like and solid oxide carriers such as silica-alumina, alumina, zeolite, mordenite and the like. Reaction may be effected at temperatures from about 20° to 150° C. in general isomerization and from about 90° to 510° C. in hydroisomerization and at pressures from about 10 to 70 kg/cm2 in both modes of reaction. General isomerization is typified by Shell liquid phase process, and hydroisomerization by Penex process, Isomax process, BP process and TIP process.

Eligible n-paraffin-free oils used herein are fractions contanining a major proportion of branched paraffinic hydrocarbons and ranging in boiling point from 20° to 200° C., preferably 30° to 150° C. They may be derived by molecular-sieving petroleum feedstocks such as straightrun gasoline, light naphtha, heavy naphtha, reformed gasoline, cracked gasoline, isomerates, alkylates, kerosene, light gas oil and the like, thus removing low-octane n-paraffins, followed by fractionation where desired. While absorbents and processing conditions are optional, the sieving treatment is suitably feasible with use of various grades of synthetic zeolite, particularly 5A-type molecular sieve, as by Iso-Siv process, Morex process and TSF process.

The amount of the fuel component to be added should be in the range of 5 to 40% by volume, preferably 10 to 30% by volume of the total gasoline. The component if smaller than 5% would fail to give sufficient research octane number and if larger than 40% would induce too much low-boiling fraction, leading to great evaporation loss and hence inadequate driving at relatively high temperature.

The gasoline contemplated under the second embodiment has a research octane number more than 95, preferably even greater than 98, as measured according to JIS K-2280.

There is no particular restriction imposed upon the type and amount of base gasolines used to produce the gasolines of the first and second embodiments. Typical examples include light naphtha fractionated from of naphtha cuts originating from atmospheric distillation of crude oil, catalytically cracked gasoline, hydrocracked gasoline, catalytically reformed gasoline, olefin-polymerized gasoline, alkylates derived by alkylation of hydrocarbns such as isobutane and the like with lower olefins, isomerates resulting from isomerizing straight lower paraffinic hydrocarbons, their fractions with a limited boiling range, their aromatic hydrocarbons and the like.

The gasoline of the first embodiment may be produced for instance by blending 25 to 50% by volume of reformed gasoline, 20 to 40% by volume of a light fraction derived from cracked gasoline at from the initial boiling point to about 90° C., 10 to 35% by volume of a heavy fraction boiling from reformed gasoline at from about 130° C. to the end point, and 5 to 25% by volume of an alkylate.

To produce the gasoline of the second embodiment, 5 to 40% by volume of an isomerate or a n-paraffin-free oil or both may be combined with 25 to 50% by volume of reformed gasoline, 0 to 40% by volume of a light fraction separated from cracked gasoline at from the initial point to about 90° C., 10 to 35% by volume of a heavy fraction boiling from reformed gasoline at from about 130° C. to the end point, and 5 to 25% by volume of an alkylate.

Importantly, the gasolines of the invention can only be obtained by strict observance of the distillation and composition characteristics defined by equations (I) to (VI) and by equations (VII) to (XII).

It has also been found that the 10% distillation temperature is preferably in the range of 40° to 55° C. and the 90% distillation temperature in the range of 150° to 175° C.

Various other additives may be employed which include for example antioxidants such as phenols and amines, metal deactivators such as Schiff type compounds and thioamide compounds, surface ignition inhibitors such as organic phosphorus compounds, detergent dispersants such as imide succinate, polyalkylamines and polyetheramines, anti-icing agents such as polyalcohols and their ethers, combustion improvers such as organic acid-derived alkali metal salts and alkaline earth metal salts and higher alcohol-derived sulfuric acid esters, anti-static agents such as anionic, cationic and ampholytic surfactants, and colorants such as azo dyes. These additives may be used alone or in combination, but should preferably be in an amount less than 0.1% by weight of the total gasoline.

Octane number improvers may also be utilized. They include for example alcohols such as methanol, ethanol, isopropanol and t-butanol, and ethers such as methyl-t-butylether. The amount of the improver to be added should preferably be smaller than 15% by weight of the total gasoline.

The invention will now be described by way of the following examples.

EXAMPLE 1 AND COMPARATIVE EXAMPLE 1

The starting materials shown in Table 1 were formulated and blended to provide a lead-free, high-octane gasoline according to the invention.

- 44 parts of crude oil-originated, catalytically reformed gasoline
- 27 parts of light fraction of crude oil-originated, catalytically cracked gasoline
- 19 parts of heavy fraction of crude oil-originated, catalytically reformed gasoline
- 10 parts of alkylate derived by alkylating isobutane with lower olefin

* parts: by volume

** crude oil: origin of the Middle East

A commercially available lead-free, premium gasoline was used as a control. The inventive and comparative gasolines showed the distillation and composition characteristics given in Table 2.

The gasolines were examined for acceleration, startability and warmup with the results shown in Table 3.

Acceleration Test 1

Road test was effected using a 1,500 cc-displacement, carburetor-type passenger car (Car A) with road: level, gear shift: top, throttle: fully opened and speed: stop to low, low to moderate and moderate to high. Acceleration was adjudged by the lengths of time required for the car to reach three different speeds of 0 –40, 40–80 and 80–120 km/hr.

Acceleration Test 2

Two passenger cars, one being of 1,800 cc displacement and injection type (Car B) and the other being of 2,000 cc displacement and injection type (Car C), were used with road: level, gear shift: top, throttle: fully opened and speed: low to high. Measurement was made at a speed of 120 km/hr starting from 40 km/hr.

Acceleration Test 3

Car A was allowed to run with road: slope at 5% upward gradient, gear shift: third and throttle: fully opened. Ascending force was determined at a speed of 40–80 km/hr.

Acceleration Test 4

Car B was used with road: slope at 6% upward gradient, gear shift: top, throttle: fully opened and speed: 40–120 km/hr.

Low-Temperature Startability Test

Startability was evaluated by the lengths of time taken for the engines of Cars A to C to start up at an ambient temperature of 0° C.

Low-Temperature Warmup Test

Cars A to C were exposed to ambient conditions at 0° C. Warmpup was determined according to the Demerit rating, the methods of test and calculation being reported in "CRC Report", No. 49, pages 65–69 and pages 4–5 (September 1978). The smaller numerical value, the better the warmup quality.

EXAMPLE 2 AND COMPARATIVE EXAMPLE 2

A gasoline according to the invention was prepared by blending the starting materials shown in Table 4.

- 47 parts of crude oil-originated catalytically reformed gasoline
- 28 parts of isomerate resulting from isomerizing pentane and hexane fractions of straight-run light naphtha
- 15 parts of heavy fraction of crude oil-originated, catalytically reformed gasoline
- 10 parts of alkylate derived by alkylating isobutane with lower olefin

* part: by volume

** crude oil: origin of the Middle East

A control was a commercial premium gasoline unleaded. The characteristics of the test gasolines were given in Table 5.

Performance test was made with the results shown in Table 6.

Acceleration Test 5

A passenger car (Car D) of 1,500 cc-displacement, and manual transmission- and carburetor-type was used with road: level, throttle: fully opened and speed: stop to low, low to moderate and moderate to high. Measurement was made of the lengths of time taken for the car to gain different speeds of 0–60 km/kr with the gear shifts changed from low to second to top and 40–80 km/hr and 80–120 km/hr at the top gear shift.

Acceleration Test 6

A 2,000 cc-displacement, manual transmission- and carburetor-type passenger car (Car E) was used with road: level, gear shift: top, throttle: fully opened and speed: low to high. Acceleration was measured at a speed of 40–120 km/hr.

Acceleration Test 7

Ascending force was adjudged with car: Car D, road: slope at 5% upward gradient, throttle: fully opened. The car was driven at speeds of 0–80 km/hr while changing the gear shifts from low to second to top and 40–80 km/hr at the third gear shift.

Acceleration Test 8

A passenger car (Car F) of 2,000 cc-displacement and automatic transmission- and injection-type was used with road: slope at 5% upward gradient, gear shift: D range, throttle: fully opened and speed: 0–120 km/hr.

Low-Temperature Startability Test

The procedure of Example 1 was followed except that Cars D and E were used.

Low-Temperature Warmup Test

The procedure of Example 1 was followed except that Cars D and E were used.

TABLE 1

| Characteristics | Reformed gasoline | Light fraction of cracked gasoline | Heavy fraction of reformed gasoline | Alkylate |
|---|---|---|---|---|
| Distillation characteristics (°C.)*1 | | | | |
| initial boiling point | 37 | 26 | 150.5 | 49 |
| 50% distillation temp | 121 | 42.5 | 160 | 100 |
| 90% distillation temp | 171 | 67 | 183.5 | 128 |
| Compositions (vol %)*2 | | | | |
| saturates content | 48.8 | 32.5 | 1.0 | 100.0 |
| olefins content | 1.0 | 67.4 | 0 | 0 |
| aromatics content | 50.2 | 0.1 | 99.0 | 0 |

*1: JIS K-2254
*2: JIS K-2536

TABLE 2

| Characteristics | Example 1 | Comparative Example 1 |
|---|---|---|
| Specific gravity (15/4° C.)*1 | 0.762 | 0.761 |
| Reid vapor pressure*2 (kgf/cm$^2$, 37.8° C.) | 0.700 | 0.615 |
| Research octane number*3 | 100.0 | 98.2 |
| Distillation characteristics (°C.)*4 | | |
| initial boiling point | 28.5 | 30 |
| 10% distil temp ($T_{10}$) | 47.5 | 54.5 |
| 30% distil temp ($T_{30}$) | 63.5 | 77.5 |
| 50% distil temp ($T_{50}$) | 95.5 | 99.5 |
| 70% distil temp ($T_{70}$) | 134.5 | 119.5 |
| 90% distil temp ($T_{90}$) | 161.5 | 154 |
| 95% distil temp ($T_{95}$) | 169.5 | 166.5 |
| end point | 198 | 197 |
| $T_{70}$–$T_{30}$ (°C.) | 71.0 | 42.0 |
| $T_{90}$–$T_{70}$/$T_{70}$–$T_{30}$ | 0.38 | 0.82 |
| Compositions (vol %)*5 | | |
| saturates content | 40.4 | 55.2 |
| olefins content | 18.6 | 10.5 |
| [VO(WHOLE)] | | |
| aromatics content | 41.0 | 44.3 |
| [VA(WHOLE)] | | |
| VO(≦ $T_{30}$) | 53.3 | 37.2 |
| VA(≦ $T_{70}$) | 94.5 | 82.3 |

*1JIS K-2249
*2JIS K-2258
*3JIS K-2280
*4JIS K-2254
*5JIS K-2536

TABLE 3

| Tests | Example 1 | Comparative Example 1 | Acceleration Rise (%) |
|---|---|---|---|
| Acceleration Test 1 (sec) | | | |
| 0–40 km/hr | 4.2 | 4.3 | 2.3 |
| 40–80 km/hr | 18.6 | 19.0 | 2.1 |
| 80–130 km/hr | 24.7 | 25.4 | 2.8 |
| Acceleration Test 2 (sec) | | | |
| Car B | 18.2 | 18.9 | 3.7 |
| Car C | 16.5 | 17.2 | 4.1 |
| Acceleration Test 3 (sec) | 20.1 | 21.0 | 4.3 |
| Acceleration Test 4 (sec) | 18.6 | 19.6 | 5.1 |
| Startability Test (sec) | | | |
| Car A | 1.0 | 2.5 | |
| Car B | 1.0 | 1.7 | |
| Car C | 0.7 | 1.3 | |
| Warmup Test (Demerit rating) | | | |
| Car A | 20 | 40 | |
| Car B | 0 | 20 | |
| Car C | 0 | 12 | |

TABLE 4

| Characteristics | Reformed gasoline | Isomerate | Heavy fraction of reformed gasoline | Alkylate |
|---|---|---|---|---|
| Distillation characteristics (°C.)*1 | | | | |
| initial boiling point | 37 | 35 | 150.5 | 49 |
| 50% distillation temp | 121 | 46 | 160 | 100 |
| 90% distillation temp | 171 | 55 | 183.5 | 128 |
| Compositions (vol %)*2 | | | | |
| saturates content | 48.8 | 100.0 | 1.0 | 100.0 |
| olefins content | 1.0 | 0 | 0 | 0 |
| aromatics content | 50.2 | 0 | 99.0 | 0 |

*1 and *2: See footnote to Table 1

TABLE 5

| Characteristics | Example 2 | Comparative Example 2 |
|---|---|---|
| Specific gravity (15/4° C.)*1 | 0.759 | 0.756 |
| Reid vapor pressure*2 (kgf/cm$^2$, 37.8° C.) | 0.660 | 0.640 |
| Research octane number*3 | 100.0 | 98.4 |
| Distillation characteristics (°C.)*4 | | |
| initial boiling point | 35 | 29.5 |
| 10% distil temp ($T_{10}$) | 47.5 | 54 |
| 30% distil temp ($T_{30}$) | 67.5 | 76.5 |
| 50% distil temp ($T_{50}$) | 95 | 96.5 |
| 70% distil temp ($T_{70}$) | 140 | 116 |
| 90% distil temp ($T_{90}$) | 167.5 | 150 |
| 95% distil temp ($T_{95}$) | 170.5 | 162 |
| end point | 199 | 193 |
| $T_{70}$–$T_{30}$ (°C.) | 72.5 | 39.5 |
| $T_{90}$–$T_{70}$/$T_{70}$–$T_{30}$ | 0.38 | 0.86 |
| Compositions (vol %)*5 | | |
| saturates content | 61.2 | 46.7 |
| olefins content | 0.5 | 8.4 |
| [VO(WHOLE)] | | |
| aromatics content | 38.4 | 44.9 |
| [VA(WHOLE)] | | |
| VO(≦ $T_{30}$) | 0.5 | 31.4 |
| VA(≦ $T_{70}$) | 96.5 | 80.5 |

*1 to *5 See footnote to Table 2

TABLE 6

| Tests | Example 2 | Comparative Example 2 | Acceleration Rise (%) |
|---|---|---|---|
| Acceleration Test 5 (sec) | | | |

TABLE 6-continued

| Tests | Example 2 | Comparative Example 2 | Acceleration Rise (%) |
|---|---|---|---|
| 0–60 km/hr | 7.5 | 7.6 | 1.3 |
| 40–80 km/hr | 18.9 | 19.3 | 2.1 |
| 80–120 km/hr | 25.6 | 26.2 | 2.3 |
| Acceleration Test 6 (sec) | 16.8 | 17.5 | 4.0 |
| Acceleration Test 7 (sec) | | | |
| 0–80 km/hr | 15.7 | 16.1 | 2.5 |
| 40–80 km/hr | 20.4 | 21.1 | 3.3 |
| Acceleration Test 8 (sec) | 23.3 | 23.8 | 2.1 |
| Startability Test (sec) | | | |
| Car D | 0.7 | 1.6 | |
| Car E | 0.5 | 1.3 | |
| Warmup Test (Demerit rating) | | | |
| Car D | 24 | 60 | |
| Car E | 0 | 12 | |

What is claimed is:

1. A gasoline free from lead and of high octane number which comprises base gasolines so blended as to meet the distillation and composition characteristics of equations (I) to (VI)

$$60 \leqq T_{70} - T_{30} \leqq 85\ (°C.) \quad \text{(I)}$$

$$0.15 \leqq \frac{T_{90} - T_{70}}{T_{70} - T_{30}} < 0.50 \quad \text{(II)}$$

$$VO(\text{WHOLE}) \leqq 25\ (\text{vol. }\%) \quad \text{(III)}$$

$$VA(\text{WHOLE}) \leqq 50\ (\text{vol. }\%) \quad \text{(IV)}$$

$$VO(\leqq T_{30}) \geqq 40\ (\text{vol. }\%) \quad \text{(V)}$$

$$VA(\geqq T_{70}) \geqq 85\ (\text{vol. }\%) \quad \text{(VI)}$$

where $T_{30}$ is a 30% distillation temperature, $T_{70}$ is a 70% distillation temperature, $T_{90}$ is a 90% distillation temperature, VO(WHOLE) is an olefins content in the total gasoline, VA(WHOLE) is an aromatics content in the total gasoline, VO($\leqq T_{30}$) is an olefins content in the total volume of a fraction boiling at or below $T_{30}$, and VA($>T_{70}$) is an aromatics content in the total volume of a fraction boiling at or above $T_{70}$.

2. The gasoline of claim 1 wherein said base gasolines are selected from the group consisting of light naphtha fractionated from naphtha cuts originating from atmospheric distillation of crude oil, catalytically cracked gasoline, hydrocracked gasoline, catalytically reformed gasoline, olefin-polymerized gasoline, alkylates derived from alkylation of hydrocarbons with lower olefins, isomerates resulting from isomerization of straight lower paraffinic hydrocarbons, fractions thereof with a limited boiling range, and aromatic hydrocarbons thereof.

3. A gasoline free from lead and of greater than 95 research octane number which comprises base gasolines and at least one fuel component in an amount of 5 to 40% by volume of the total gasoline, said fuel component being either one or both of an isomerate and a n-paraffin-free oil, thereby meeting the distillation and composition characteristics of equations (VII) to (XII)

$$60 \leqq T_{70} - T_{30} \leqq 85\ (°C.) \quad \text{(VII)}$$

$$0.15 \leqq \frac{T_{90} - T_{70}}{T_{70} - T_{30}} < 0.50 \quad \text{(VIII)}$$

$$0 \leqq VO(\text{WHOLE}) \leqq 25\ (\text{vol. }\%) \quad \text{(III)}$$

$$VA(\text{WHOLE}) \leqq 50\ (\text{vol. }\%) \quad \text{(X)}$$

$$0 \leqq VO(\leqq T_{30}) \leqq 40\ (\text{vol. }\%) \quad \text{(XI)}$$

$$VA\ (\geqq T_{70}) \geqq 85\ (\text{vol. }\%) \quad \text{(XII)}$$

where $T_{30}$ is a 30% distillation temperature, $T_{70}$ is a 70% distillation temperature, $T_{90}$ is a 90% distillation temperature, VO(WHOLE) is an olefins content in the total gasoline, VA(WHOLE) is an aromatics content in the total gasoline, VO($\leqq T_{30}$) is an olefins content in the total volume of a fraction boiling at or below $T_{30}$, and VA($>T_{70}$) is an aromatics content in the total volume of a fraction boiling at or above $T_{70}$.

4. The gasoline of claim 3 wherein said isomerate is a fraction derived by isomerizing either one or both of pentane and hexane and boiling in the range of 25° to 85° C.

5. The gasoline of claim 3 wherein said n-paraffin-free oil is a fraction resulting from molecular sieving of a petroleum feedstock and boiling in the range of 20° to 200° C., said petroleum feedstock being selected from the group consisting of straight-run gasoline, light naphtha, heavy naphtha, reformed gasoline, cracked gasoline, isomerate, alkylate, kerosene and light gas oil.

* * * * *

UNITED STATES PATENT AND TRADEMARK OFFICE

CERTIFICATE OF CORRECTION

PATENT NO. :4,824,552

DATED :April 25, 1989

INVENTOR(S) :Takao NAGASAWA, Kingo IKEDA and Hirotsugu NOMURA

It is certified that error appears in the above-indentified patent and that said Letters Patent is hereby corrected as shown below:

In claim 1, column 9, line 43 of the Patent, change:

"$VA(>T_{70})$" to --$VA(\geq T_{70})$--.

In claim 3, column 10, line 34 of the Patent, change:

"$VA(>T_{70})$" to --$VA(\geq T_{70})$--.

Signed and Sealed this

Fifteenth Day of April, 1997

Bruce Lehman

*Attest:*

BRUCE LEHMAN

*Attesting Officer*

*Commissioner of Patents and Trademarks*